United States Patent [19]

Scheffer

[11] 4,325,424

[45] Apr. 20, 1982

[54] SYSTEM AND PROCESS FOR ABATEMENT OF CASTING POLLUTION, RECLAIMING RESIN BONDED SAND, AND/OR RECOVERING A LOW BTU FUEL FROM CASTINGS

[76] Inventor: Karl D. Scheffer, 121 Governor Dr., Scotia, N.Y. 12302

[21] Appl. No.: 130,256

[22] Filed: Mar. 14, 1980

[51] Int. Cl.[3] ..... B22D 23/00; B22D 27/15

[52] U.S. Cl. ..... 164/5; 164/7; 164/61; 164/255; 164/16; 164/76.1; 164/124

[58] Field of Search ..... 164/5, 7, 160, 124, 164/61, 62, 65, 76, 253–256, 270, 16, 12; 423/210 C, 224; 266/138, 144; 110/210, 234

[56] References Cited

U.S. PATENT DOCUMENTS

| | | | |
|---|---|---|---|
| 1,031,305 | 7/1912 | West | 164/124 |
| 3,165,302 | 1/1965 | Krouse | 266/144 X |
| 3,617,043 | 11/1971 | Hirao | 266/144 X |
| 3,941,868 | 3/1976 | Riester | 164/76 X |
| 4,064,926 | 12/1977 | Naegele | 164/160 X |
| 4,154,055 | 5/1979 | Pulick et al. | 266/141 X |
| 4,222,429 | 9/1980 | Kemp | 164/34 |
| 4,226,277 | 10/1980 | Matalon | 164/7 |

FOREIGN PATENT DOCUMENTS

| | | | |
|---|---|---|---|
| 51-100915 | 9/1976 | Japan | 266/144 |

*Primary Examiner*—Robert D. Baldwin
*Assistant Examiner*—K. Y. Lin
*Attorney, Agent, or Firm*—Donald M. Winegar

[57] ABSTRACT

A low vacuum is applied to selected surface areas of a resin bonded sand mold to draw ambient air into selected portions of the mold. The air entering the mold burns out a significant portion of the resin binder to form a low BTU gas fuel and to recover casting heat for use in a waste heat boiler or other heat abstractions device. Therefore, foundry air pollution is reduced, the burned out portion of the molding sand is recovered for immediate reuse, and a savings in fuel and energy.

11 Claims, 2 Drawing Figures

SYSTEM AND PROCESS FOR ABATEMENT OF CASTING POLLUTION, RECLAIMING RESIN BONDED SAND, AND/OR RECOVERING A LOW BTU FUEL FROM CASTINGS

BACKGROUND OF THE INVENTION

1. Field of Invention

This invention relates to resin bonded sand molds and in particular to a system and process for reducing casting pollution, recovering a portion of the molding sand for immediate reuse, producing a low BTU gas fuel by partial combustion of the bonding resin, and recovering a portion of the casting heat.

2. Description of the Prior Art

Heretofore, current foundry practice employing no-bake molds and cores have separate ventilation and sand reclamation operations. Organic waste products are removed from molds and cores in dry scrubbers and transported to dumping sites for disposal; the scrubbed sand is returned for reuse. At the present time there is no practical use for recovered binder residues. Care must be exercised in disposing of the organic waste products, since they pose a potential problem for the environment.

Present ventilation systems include the dilution of foundry air with large quantities of unpolluted air and removing the same from the foundry by forced air and/or induced air systems. The air removed from the foundry is exhausted into the outside atmosphere where air standards are still lenient enough to permit such operation. The existing systems must move huge quantities of air and are therefore expensive to install and maintain operation thereof. Additionally, extra fuel is required to preheat the make-up air for the foundry operation.

Under normal foundry practice, large quantities of silica dust can be present in the foundry environment. This is particularly true in the areas devoted to pouring and shakeout operations. As stated in a volume of American Society for Metal's Handbook, silica dust can produce silicosis if there is sufficient exposure, in terms of time and concentration, to free crystalline silica dust of particle size below five microns. When silica dust concentrations greatly exceed the maximal allowable, a case of silicosis can develop within two to twenty years, the average being ten years.

In no-bake molding practices employing organic foundry sand binders environmental effects must be considered for products of the thermal decomposition of the organic binders. The smoke and thermal decomposition products require control equipment. Thermal decomposition products include, but are not limited to, carbon monoxide, carbon dioxide, nitrogen, hydrogen, methane, formaldehyde, ammonia, hydrogen cyanide, acetylene, ethane, paraffin hydrocarbons, aromatic organic compounds, and the like.

The three major sand reclamation systems currently available to foundrymen using no-bake sands are thermal, wet and dry scrubbing. Thermal reclamation is the most expensive system to install and operate, but produces the cleanest reclaimed sand. A thermal reclaimer requires in the order of 1.5 million BTU's of heat per ton of sand, or 4.5 million BTU's per ton of metal cast, at 3:1 sand to metal ratio to remove up to 96 percent of organic binder residues from any organic no-bake sand mold system. The thermal reclamation system is seldom employed in the industry.

A wet reclamation system is less expensive to operate than a thermal reclamation system, but more expensive than a dry scrubbing system. A wet reclamation system will remove from 35 percent to 45 percent of the organic binder residue from the used no-bake molding sand system. However, the sludge byproduct of the wet reclamation operation requires an environmental safe disposal site.

A dry scrubber system is the least efficient system to reclaim used no-bake foundry sand, its efficiency being of the order of removal of from 25 percent to 35 percent of the binder residues from the sand processed for a shotblast type dry scrubber. This process is employed most often because of its low cost installation.

In the dry scrubber system of reclamation, the sand is crushed and its surface abraded resulting in up to 20 percent of the sand processed being lost because of "dust losses". The wet reclamation system has a less severe "dust loss" process and the thermal system has the least "dust loss" problem.

The binder residues removed by the sand reclamation system have no practical use at this time and their disposal method is dumping.

An object of this invention is to provide a new and improved system and process for casting metals in no-bake sand molds.

Another object of this invention is to provide a new and improved apparatus and process for reducing air pollution in foundries employing no-bake sand molds.

A further object of this invention is to provide a new and improved apparatus and process for causing air to flow through selected regions of a no-bake sand mold to thermally decompose the organic binder therein to produce a gas having a low BTU content.

A still further object of this invention is to provide a new and improved system for insitu thermal recovery of sand from a no-bake sand mold, producing a gas therefrom that has a low BTU content which is storable or can be utilized in several ways for preheating air, and water, for providing heat as required in the foundry.

Another object of this invention is to recover the casting heat from the casting during the cooling cycle.

BRIEF DESCRIPTION OF THE INVENTION

In accordance with the teachings of this invention there is provided a new and improved mold system and process for no-bake casting mold assemblies. Each mold assembly comprises a cope, a drag and a no-bake foundry sand composition including an organic binding material. The improved system includes a mold assembly disposed on a vacuum plenum. The mold assembly is oriented with the plenum so that the bottom surface of the mold assembly has good air and gas communication means with the vacuum plenum. A communicative means joins a vacuum source means, such as a blower, to the vacuum plenum member. When operative, the vacuum source means induces the ambient about the mold assembly to flow through the mold and into the vacuum plenum member.

The new and improved system permits an operator to collect a low BTU gas comprising gas products and condensate matter evolved by the mold assembly into the vacuum plenum member. Combustion air may be mixed with the collected gas products and condensate matter to form a combustible mixture. The combustible mixture may be burned to preheat combustion air as required, produce hot water, or to enable one to heat treat castings in the mold assemblies.

DESCRIPTION OF THE INVENTION

Figure 1:
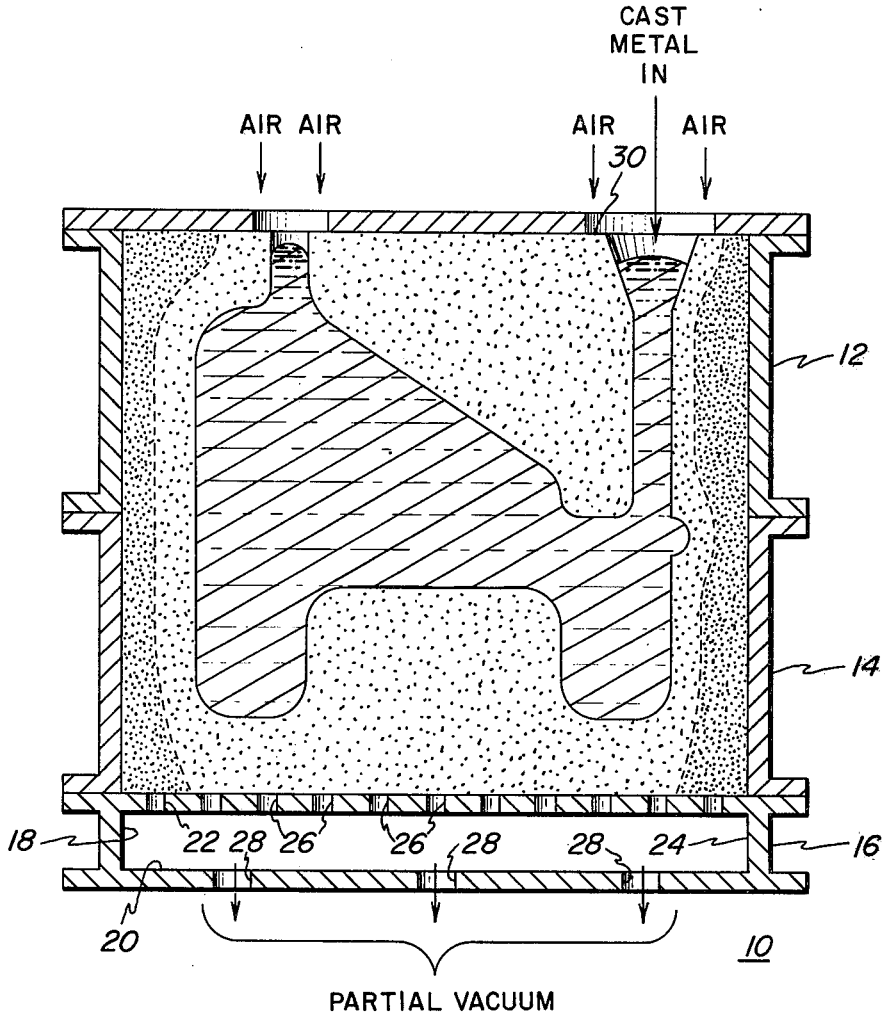
FIG. 1 is a side elevation view in cross-section of a mold assembly embodying a vacuum plenum member.
Figure 2:
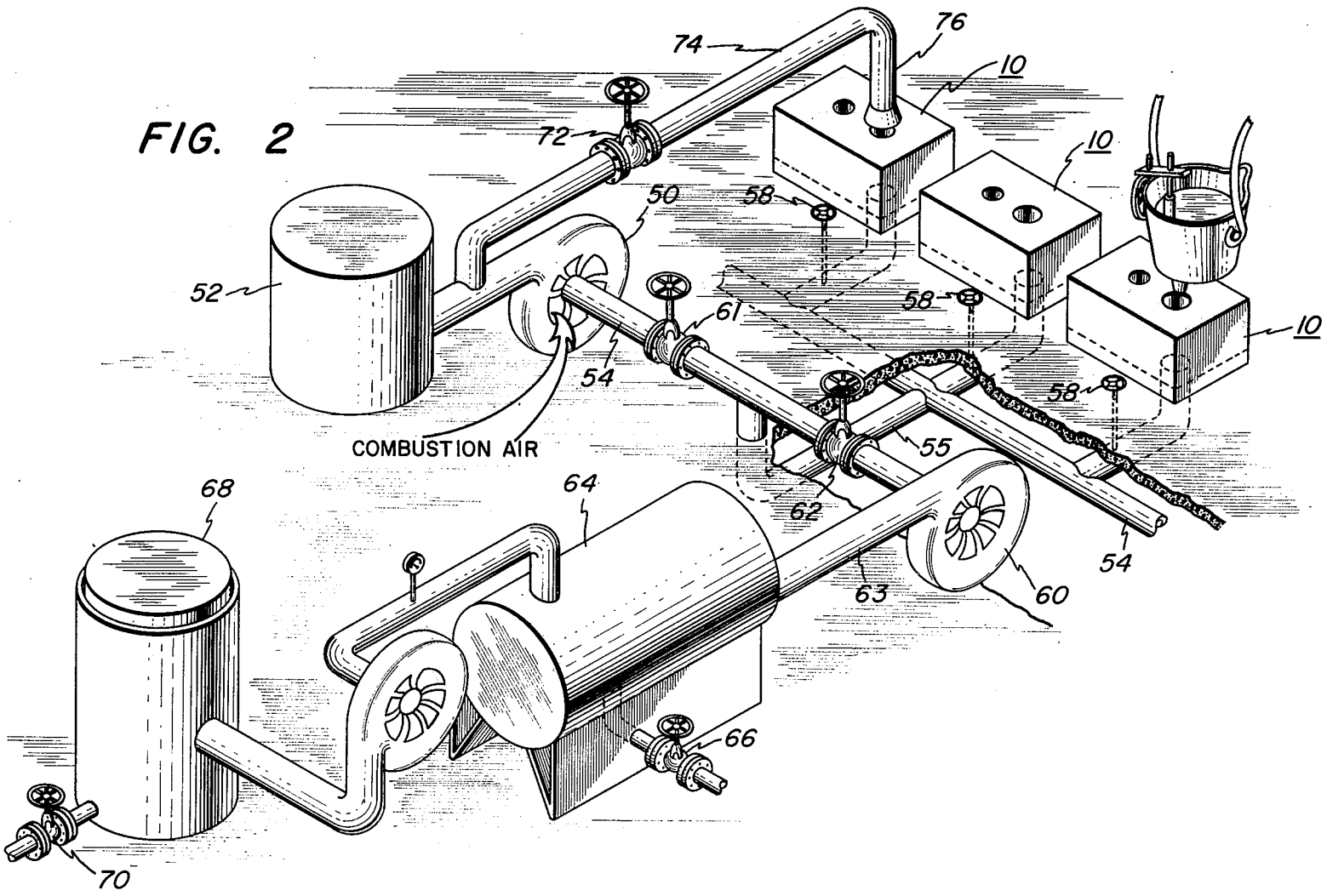
FIG. 2 is a schematic view of a system for recovering and employing a low BTU fuel produced by the molding system of this invention.

With reference to FIGS. 1 and 2, there is shown a mold assembly 10 comprising a cope 12, a drag 14, and a perforated support member 16 having walls 18, 20, 22 and 24 defining plenum chamber therein. Organic resin bonded sand is shaped on a pattern to form the cavity to be cast therein. The member 16 supports the mold assembly 10 and may be sealed at its juncture with the bottom of the mold assembly 10 to provide a good air-tight-seal therewith. In a similar manner an air tight seal is provided by the abutting surfaces of the cope 12 and drag 14. Walls 26 define a plurality of apertures extending entirely through the wall 20 to provide a communicant means for air to flow.

Vacuum means, not shown, are attached to the support member 16, and when operative, cause air to draw downward through the mold assembly 10 from the top surface 30, through the apertures defined by walls 26 and 28 respectively. The vacuum is applied shortly before casting of the melt. The vacuum is maintained during casting and at least a portion of the time after casting is complete and before shake-out occurs. The air which is drawn into the sand of the mold is heated by the cast metal in the regions of the sand about the metal casting thereby forming an initial hot sand zone. The heat is sufficient to make the sand become incandescent. The heated air supports combustion of the organic binder residues and increases the heat content of the air causing the initial hot sand zone to grow greater in size and to extend further from the casting toward the end and side surfaces of the mold assembly 10. An ever increasing amount of organic binder material is burned out of the sand mold. The greatest growth of the hot sand zone is that portion of the mold assembly 10 in direct communication with the vacuum means. Approximately 50 to 70 percent by volume of the sand can be burned free of its organic binder materials.

In the no-bake mold making system to which this invention is directed, the organic binder system or material comprises from 1 percent to 2 percent by weight of the sand composition and include furan, alkyd resins, phenol formaldehyde, phenolin, phenolic urethane, and the like materials. The particular choice of binder material depends upon the type of casting practice followed, type of molds being used, and particularly the time allotted to mold preparation to meet the economics of a particular foundry operation practice. Furans and alkyd resins normally set slowly while phenolics and polyurethanes are known to set faster. The choice of binders is determined by foundry practice, preference, and/or economics.

The volume of air and the flow rate of air can both be controlled in this system to enable one to produce a low BTU gas content in the hot gases. The hot gases which include the low BTU gas therein, are recovered to be burned in a waste heat boiler and/or a heat recovery unit to extract the heat values from the low BTU gas as well as the casting heat content of the gas. The low BTU gas and hot gas mixture may also be employed as a means for providing heat in hot top casting practices.

The burn-out efficiency of the process, as well as the BTU content of the low grade gas is dependent upon the type of molding equipment employed, the configuration of the casting to be poured, the molding sand to cast metal ratio, the amount of sand mold surface exposed directly to the surrounding ambient in the foundry, and the design of the system to cause the air to be drawn through the mold and to transport the gases from the mold to a particular distant point. Should the ambient air of the foundry be drawn in over the whole mold surface, the low BTU gas formed is diluted by the excess air drawn through the mold. Should the mold surfaces be sealed completely against the entrance of air by such suitable means as a spray coating material, sheets of material, and the like, the only air able to enter into the mold will be drawn into the mold around incandescent portions of mold surrounding the pouring cup, gate, and open risers which project to the top mold surface. The combustion of air and organic binder material produces a low BTU gas. The combustion, or burning of the organic resin binder material usually occurs in a straight line from the initial point of combustion to the perimeter of the casting and then fairly directly toward the plenum chamber of the support member 16. Some expansion of the initial burned out regions occurs as a result of heat conduction and gas diffusion into the abutting no-bake sand composition.

Upon completion of casting the molten metal and further combustion of the organic binder materials cannot be achieved, the vacuum may be increased to draw greater quantities through the mold in order to cool the casting faster. For best all around results, cooling of the casting should be achieved through a separate air evacuation system.

Castings made in this manner have been evaluated and found to have better qualities because of less surface gas in contact with the casting and surface roughness has also been reduced from prior art casting methods.

As illustrated in FIG. 2, the vacuum means may be supplied by a blower 50 which mixes the low BTU gases with a sufficient quantity of air to fire a waste heat boiler 52. Means for transporting the low BTU gas from each mold 10 to the blower 50 may be conduit means 54 and 55, a valve means 61, and conduit means 54 in the floor 56 controlled by flow valve 58. In this instance the combustion of the low BTU gas from the mold 10 is employed to produce steam for operating foundry equipment.

Additionally, a blower 60, via valve means 62 and conduit means 63, may direct the flow of low BTU gas produced through a condenser 64. The condenser 64 enables one to recover the casting heat and to separate tarry oil from the gas via valve means 66 before directing the gas to storage tank 68. Valve means 70 enables one to draw low BTU gas to fire casting heat treat and/or hot-top accessory means as required.

Valve means 72 enables the combustible gas mixture from blower 50 to be directed via conduit means 74 to hot top and/or heat treating accessory means 76 as required for each mold assembly 10.

The system and method of this invention enables the using foundry to substantially reduce air pollution of the ambient of the foundry. Whereas prior casting methods released large amounts of hot gases and particulate matter into the foundry air, the system and method of this invention draws the hot gases and particulate matter into a confined area to be disposed of properly without contaminating the foundry air about the work stations therein. The castings produced are of excellent quality and are readily shaken out of the "burned" sand. The "burned" sand is readily reclaimed for reuse without introducing pollution problems of sludge and the like which occurred in the prior art methods. The no-bake sand composition which has not had the organic binder burned out constitutes only 30 to 50 percent by volume of the original sand composition of the mold. This portion of the original volume of sand composition employed in the mold is recovered crushed, screened and combined with the reclaimed sand of this process, cooled and returned for reuse. Pollution problems are greatly reduced by this method.

The following example illustrates the teachings of this invention:

Two MES scab plate mold assemblies were prepared in matchplate flasks using PEPSET TM and Wedron 5010 sand. PEPSET is the registered trademark of Ashland Chemical Company for a patented phenolic-urethane three part binder system. One part contains a phenolic resin, a second part contains an isocyanate component, and a third part consists of a liquid catalyst. One mold assembly was employed as a control. No attempt was made to seal any of the top surfaces of the mold to restrict air penetration or gas evolution.

A 12" by 14" aluminum jacket was inverted and placed on the foundry floor to act as a vacuum plenum for the second mold assembly. A first neoprene rubber seal provided an air tight seal between the floor and the jacket. The second mold assembly was disposed on the other side of the jacket with a second neoprene seal affixed to the assembly and the jacket to provide an air tight seal therebetween. An industrial vacuum cleaner purchased from Sears, Roebuck and Company was attached to the vacuum plenum to provide the vacuum means.

The industrial vacuum cleaner was turned on and a considerable current of air could be felt entering into the mold through the top surface indicating a good air tight seal obtained through employment of the neoprene seal. Gray iron was poured into the two molds. The pouring temperature was 2700° F. The molds were then observed for a period of 45 minutes following the pour. No attempt was made to collect condensate matter.

The vacuum assembly reduced the smoke levels considerably. No smoke was evolved from the vacuumed mold until traces were observed at 20 minutes following the pour, while smoke from the control mold was light to moderate.

Visual examination of the castings revealed that there was no increase in penetration of the vacuum casting when compared with the control casting. The surface of the castings was acceptable for commercial quality. The vacuumed mold was more thermally reclaimed, about 70 percent of the binder had been burned out, than the control mold.

Condensate matter was observed collected in the cannister of the vacuum cleaner.

Further evaluation of the system and method of this invention indicates the vacuum type system works more efficiently with casting processes wherein high thermal energy is present in the mold such as iron, steel, copper alloy castings and the like. Less efficiency in burnout and shakeout is achieved in low thermal energy molds such as obtained in aluminum castings. In all instances foundry air contamination is substantially reduced. The low BTU gases evolved in the vacuum casting process of this invention range from 90 BTU's per 1000 cubic feet to 180 BTU's per 1000 cubic feet depending upon the type of organic binder and casting temperature. The low BTU gases have proven to be an excellent source of fuel for waste heat boilers, heating hot tops, heat treating the castings in the mold assembly, and the like.

I claim as my invention:

1. An improved mold system for no-bake casting mold assemblies comprising a cope, a drag and a no-bake foundry sand composition including an organic binding material, the improvement comprising a vacuum plenum member;

a mold assembly disposed on the vacuum plenum and oriented therewith so that the bottom surface of the mold assembly has good air and gas communication means with the vacuum plenum;

a vacuum source means;

conduit means joining the vacuum source means to the vacuum plenum member;

the vacuum source means when operative induces the ambient about the mold assembly to flow through the mold and into the vacuum plenum member;

means for collecting a low BTU content gas comprising gaseous products and condensate matter evolved by the mold assembly into the vacuum plenum member;

means for mixing combustion air with the low BTU content gas to form a combustable mixture, and means for burning the combustible mixture to generate thermal energy.

2. The improved mold system of claim 1 and including a blower means for mixing the combustion air with the low BTU content gas.

3. The improved mold system of claim 2 and including a waste heat boiler, means for connecting the blower means to the waste heat boiler for introducing the combustible mixture into the boiler for burning therein.

4. The improved mold system of claim 1 and including hot top and/or heat treat accessory means oriented with respect to the mold assembly and including the means for forming the combustible mixture, and conduit means connecting the hot top and/or heat treat means to the mixing means.

5. The improved mold system of claim 1 and including condenser means for recovering casting heat and to separate tarry oil from the low BTU content gas, and means for storing the low BTU content gas after passage through the condenser means.

6. A method for casting molten metal in a no-bake sand mold assembly comprising (a) affixing a vacuum inducing source to the bottom surface of the no-bake mold assembly;

(b) applying a partial vacuum to the bottom surface of the no-bake mold assembly;

(c) inducing an increased flow of ambient air into the mold through selected surface areas of the mold assembly;

(d) casting molten metal into mold assembly while maintaining the partial vacuum;

(e) heating portions of the sand mold assembly to a temperature sufficient to decompose the organic binder materials bonding the mold sand together to produce a low BTU content gas and burned out regions of sand;

(f) cooling the casting in the mold assembly for a period of time while maintaining the partial vacuum, and (g) recovering the burned sand from the mold assembly for reuse in making a foundry molding sand composition for casting molten metal.

7. The method of claim 6 and including the additional process steps of collecting the low BTU content gas, passing the low BTU content gas through a condenser to recover casting heat and to separate tarry oil from the gas, and storing the gas after passing through the condenser.

8. The method of claim 6 and including the additional process steps of collecting the low BTU content gas, mixing combustion air with the low BTU content gas to form a combustible mixture, and burning the combustible mixture to produce thermal energy.

9. The method of claim 8 and including the additional process step of utilizing the thermal energy to heat the hot top of a mold assembly.

10. The method of claim 8 and including the additional process step of utilizing the thermal energy to heat treat the casting in the mold assembly.

11. The method of claim 8 and including the additional process step of utilizing the thermal energy in a waste heat boiler.

* * * * *